United States Patent [19]

Saotome

[11] Patent Number: 5,010,461

[45] Date of Patent: Apr. 23, 1991

[54] MULTICOLOR PRESSURE-SENSITIVE ILLUMINATING DISPLAY PLATFORM

[76] Inventor: Kunio Saotome, 1-1-4 Nakamurakita, Nerima-ku, Tokyo, Japan

[21] Appl. No.: 448,724

[22] Filed: Dec. 11, 1989

[51] Int. Cl.[5] ..... F21V 33/00

[52] U.S. Cl. ..... 362/101; 362/802

[58] Field of Search ..... 362/101, 154, 189, 293, 362/125, 802; 200/314

[56] References Cited

U.S. PATENT DOCUMENTS

| | | | |
|---|---|---|---|
| 2,943,185 | 6/1960 | Mott | 362/101 |
| 4,336,574 | 6/1982 | Goodman | 362/101 |
| 4,344,113 | 8/1982 | Ditto et al. | 362/101 |
| 4,496,812 | 1/1985 | Carley et al. | 200/314 |
| 4,551,598 | 11/1985 | Hamilton et al. | 200/314 |
| 4,858,084 | 8/1989 | Sheryll | 362/101 |

*Primary Examiner*—Ira S. Lazarus
*Assistant Examiner*—Sue Hagarman
*Attorney, Agent, or Firm*—Christensen, O'Connor, Johnson & Kindness

[57] ABSTRACT

A display platform (11) for exhibiting an object (19) by illuminating the object in a selectable plurality of color and/or color patterns. The illuminating source (31) is activated by a pressure-sensitive switch (16) which will engage only if an object (19) of sufficient mass is placed on the pressure sensitive switch (16). Variation of illuminating color or pattern is accomplished by a sequentially registrable filter disk (41) that is placed between the illuminating source (31) and the object to be displayed (19). The electrical power supply (21) that energizes the illuminating source (31) located within the platform (11).

12 Claims, 3 Drawing Sheets

Fig. 1.
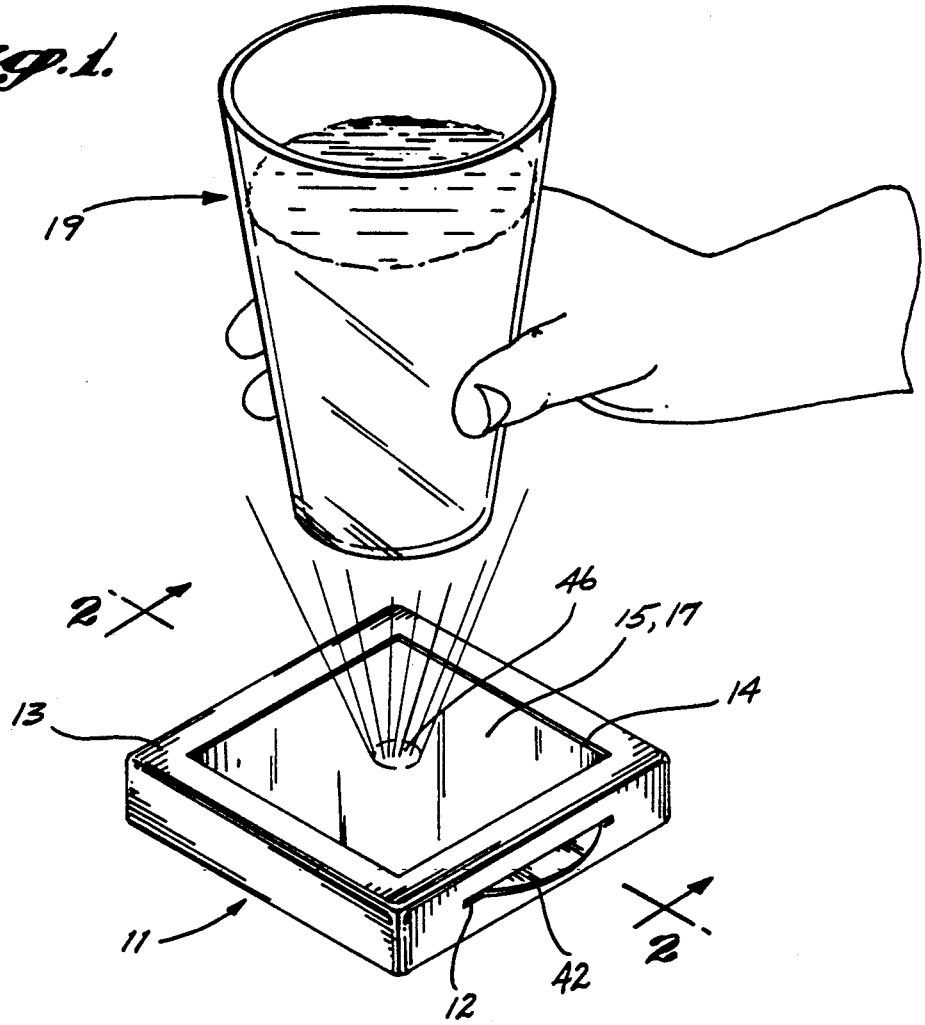
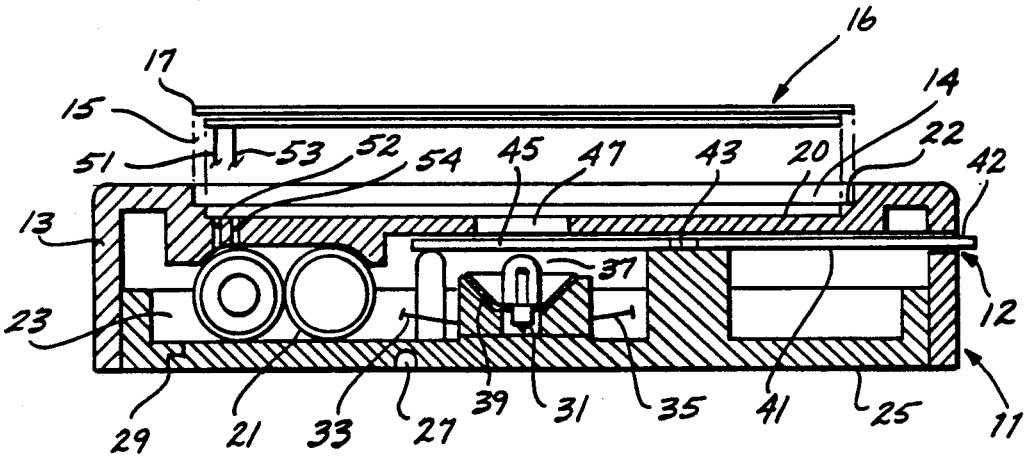
Fig. 2.

MULTICOLOR PRESSURE-SENSITIVE ILLUMINATING DISPLAY PLATFORM

TECHNICAL AREA

This invention relates to display platforms and, more particularly, to illuminating display platforms.

BACKGROUND OF THE INVENTION

An objective in many situations is the display of objects in an aesthetically pleasing or novel manner. This is often accomplished by placing the object to be displayed on a display platform. In many instances the display is enhanced by illuminating the platform-supported object. Typically, display platforms have relied upon external lighting provided by a separate external light source, such as room tract lighting or a portable lamp placed near the display platform. As is often the case in these external lighting mechanisms, the light bulbs are incandescent and unvarying in color and illumination effect. A further disadvantage is that external illumination sources often must be manually controlled by the displayer. For example, with tract lighting, each individual light must be manually adjusted to a desired position. Also, to activate the light source, a switch mechanism, which is often an appreciable distance from the actual display platform, must be actuated. This makes the use of external light sources cumbersome.

There are available display platforms that provide a completely integrated system of object support and illumination. Unfortunately, they have a number of disadvantages. In most instances, manual actuation of a switch that controls the illumination of the object is required. Further, previously developed integrated display platforms are often bulky and prohibitively expensive for use in many applications.

This invention provides an integrated display platform that overcomes many of the disadvantages of previously developed display platforms. More specifically, this invention provides a self-contained display platform for use in a variety of settings. Objects which are translucent or transparent are especially amenable to display using a platform formed in accordance with the invention.

SUMMARY OF THE INVENTION

In accordance with this invention, an illuminating display platform for displaying objects is provided. The platform automatically senses the presence of an object to be displayed and, when an object is sensed, illuminates the object. The platform includes a housing and a pressure-sensitive switch positioned in the housing such that the switch is triggered when an object of sufficient mass is placed on the display platform. Triggering of the pressure-sensitive switch energizes an illumination source, i.e., a lamp, disposed within the housing. The lamp is positioned such that the object is illuminated from below when the lamp is energized, giving an intriguing and unusual visual effect to the object.

In accordance with other aspects of the invention, the object can be illuminated by any one of a variety of colors and/or color patterns. This is accomplished by locating a plurality of filters in the housing of the display platform. The filters are arranged so as to be selectively registrable between the lamp and the object to be illuminated. Preferably, the power supply and all circuitry as well as the lamp are contained within the housing.

In accordance with further aspects of this invention, the pressure-sensitive switch is implemented by two insulating membranes, each etched on one surface with a conductive pattern. The etchings face one another. When no pressure is applied to the membranes, the membranes are held in a slightly spaced apart position whereby the etchings do not contact, and the switch is open. When weight is applied to the membranes at least one of the membranes deflect, causing the etchings to contact one another. Contact between the etchings completes the circuit between the power supply and the lamp, causing the object to be illuminated from below. Preferably, the insulating membranes are horizontally positioned in a recess located in the top of the housing. Also, preferably, the insulating membranes are mounted on the housing in a completely waterproof manner, i.e., constructed such that water cannot short the etchings when no pressure is applied to the membranes.

The use of a pressure-sensitive switch and a plurality of available color filters make this invention advantageous in a variety of settings where automatic variable light display is desired. The mounting of the pressure-sensitive switch, lamp, and power source in a common housing creates a portable display platform that further enhances the usefulness of this invention. Portability makes embodiments of the invention particularly amenable for use as a coaster. Typically, coasters merely supply a shield between a liquid container and a supporting surface. When this invention is used as a coaster, glass containers placed on the coaster are lit and become visually attractive. More specifically, the illumination of a glass container containing ice cubes and a translucent liquid creates an aesthetically pleasing display.

BRIEF DESCRIPTION OF THE DRAWINGS

The foregoing and other advantages and features of this invention will become more readily appreciated as the same becomes better understood by reference to the following detailed description when taken in conjunction with the accompanying drawings wherein:

FIG. 1 is a pictorial diagram of a display platform formed in accordance with this invention;

FIG. 2 is a side sectional view of one embodiment of the invention taken approximately along line 2—2 of FIG. 1;

DESCRIPTION OF THE PREFERRED EMBODIMENT

Figure 3A:
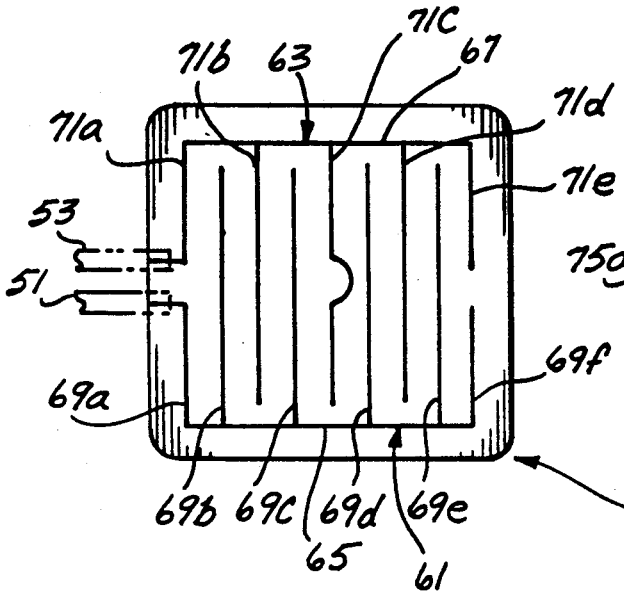
FIG. 3A is a plan view of a first flexible membrane with an electrically conductive etching pattern.

The embodiment of the invention illustrated in FIGS. 1-5 is a display platform 11 designed to be used as a coaster. As seen in FIG. 1 the display platform 11 includes a housing 13 having a right rectangular parallelepiped configuration. Mounted in a recess 14 (FIG. 2) formed in the top of the housing 13 is a pressure-sensitive switch 16. The pressure-sensitive switch 16 is formed by first and second membranes 15 and 17, which are best illustrated in FIGS. 3A and 3B and described below. A light aperture 47 is located centrally on the top surface 20 of the housing 13, at the bottom of recess 14. An illuminating lamp 37 is disposed within the housing 13, beneath the light aperture 47 and in alignment therewith. The illuminating lamp 37 is mounted in an illuminating lamp receptacle 31 and surrounded by a conical reflector 39, which serves to direct light toward the light aperture 47. Two electrical leads 33 and 35, attached to the illuminating lamp receptacle 31, lead to the dry cell batteries 21 and the pressure-sensitive switch 16, respectively. A rotatable filter disk 41 is mounted within the housing 13 on shaft 43. Located on the filter disk 41 are a plurality of translucent filters 45. The rotatable filter disk 41 is positioned such that the translucent filters 45 can be selectively positioned between the light aperture 47 and the illuminating lamp 37 and, thus, color the light that passes through the light aperture 47.

The particular arrangement of the elements can best be seen in FIG. 2. As noted above, the housing 13 contains a rectangular, stepped recess 14 on its top surface that receives the switch membranes 15 and 17. The switch lower membrane 15 has the same size and rectangular peripheral shape as the lower surface 20 of the recess 14. The periphery of surface 20 is defined by a shoulder 22 that forms a ledge for supporting the perimeter of the upper switch membrane 17 at an elevation spaced above the membrane 15 to define a thin gap between the membranes. Two electrical leads 51 and 53 connected to the first membrane 15 pass through holes 52 and 54 in the top surface 20 of housing 13 and extend into the interior of the housing. Located in the membranes 15 and 17 in vertical alignment with the housing light aperture 47 is a clear aperture 46. Preferably, the light aperture 47 and the clear aperture 46 are centrally located. It will be appreciated that the clear aperture 46 of the membranes 15 and 17 and the housing light aperture 47 provide a light channel for light produced by the illuminating lamp 37.

Continuing to refer to FIG. 2, the illuminating lamp receptacle 31 is oriented such that the illuminating lamp 37, when inserted, will be vertical, i.e., orthogonal to the top surface of the housing 13. The conical reflector 39 is placed circumferentially about the illuminating lamp receptacle 31 with the narrow portion of the conical reflector secured to the bottom of the interior of the housing 13. The conical reflector's inner surface, which faces the illuminating lamp 37, is coated with a light reflective material that focuses the illuminating light upward toward the housing aperture 47.

Located within a chamber 23 in the housing 13, that is displaced laterally from the center of the housing 13, are two dry cell batteries 21. The batteries 21 are cylindrically shaped and are disposed with the batteries longitudinal axis parallel to one another and to a side wall of housing 13. The battery chamber 23 is shaped to accommodate the two dry cell batteries 21 in this parallel arrangement. The bottom surface of the housing 13 contains a hinged door 25 disposed directly under the battery chamber 23. The hinged door 25 is sized to allow batteries to be inserted into the battery chamber 23. The hinged door is secured by a battery door latch 29 and rotatable about a door hinge pivot 27. The battery door latch 29 is located across the hinged door 25 from door hinge pivot 27.

Figure 4:
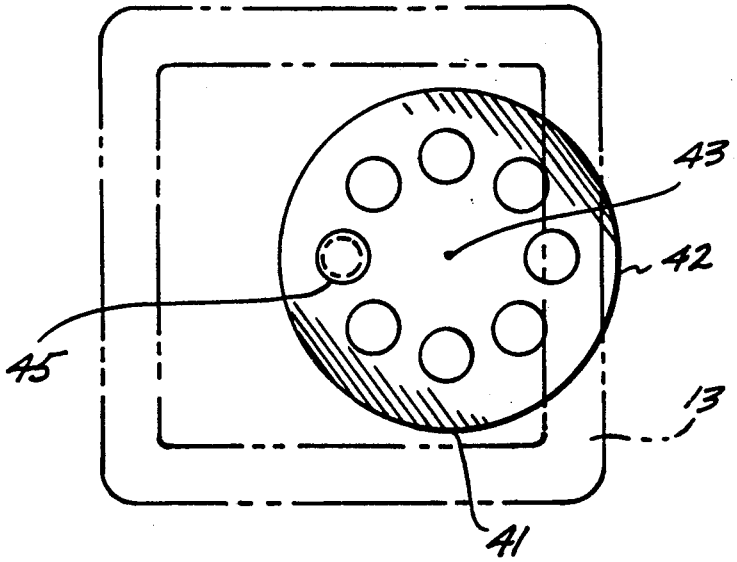
FIG. 4 is a plan view of a rotatable color template and its positioning in the housing of the display platform illustrated in FIG. 1.

Disposed in the housing 13, on the opposite side of the illuminating lamp receptacle 31 from the dry cell battery 21, is a shaft 43 whose longitudinal axis of rotation runs parallel to the side wall of the housing 13 and orthogonal to the top surface of housing 13. Mounted on the shaft 43 so as to be oriented parallel to the bottom surface of the housing 13 and parallel to the switch membranes 15 and 17 is a rotatable filter disk 41. More specifically, the center of the rotatable filter disk 41 is attached to the upper end of the shaft 43. The shaft 43 is sized and positioned such that the filter disk lies above the illuminating lamp 37 and conical reflector 39. As seen in FIG. 4, the radius of the disk is such that the disk radius extends beyond the illuminating lamp 37 on one side and beyond a side wall of housing 13 on the other. The filter disk 41 protrudes through a side wall aperture 12 formed in one side of the side wall of housing 13. The wall aperture 12 in the housing side wall is disposed at the same height as the filter disk. The height of the actual wall aperture 12 is slightly greater than the thickness of the rotatable filter disk 41. The length of the wall aperture 12 is slightly greater than the length of the chord that defines the protruding part of the disk 42.

As shown in FIG. 4, located at equidistant radii from the center shaft 43 are a plurality of equally spaced translucent color and/or pattern filters 45, which are designed to alter the composition of the light emanating from the illuminating lamp 37. The filters 45 are of circular shape and are spaced from one another by an opaque portion of rotatable filter disk 41. The radius location of the individual filters 45 is such that the filters 45 are positionable between the lamp 37 and the housing light aperture 47. The diameter of the circular filters 45 is slightly larger than the diameter of the housing light aperture. Thus, a plurality of various color and/or color patterns may be used to illuminate the object. It is to be understood that the patterned or colored filters 45 need not be of the circular shape illustrated in FIG. 4. The rotatable filter disk 41 may contain patterned or colored filters 45 in a variety of other shapes and arrangements such as colored sectors, gradual gradations in color, or even squared-shape filters. The important consideration is that the filters 45 are sized and positioned so as to allow light to pass from the illuminating lamp 37 through the housing light aperture 47 and onto an object 19 positioned atop the pressure-sensitive switch 16.

Figure 5:
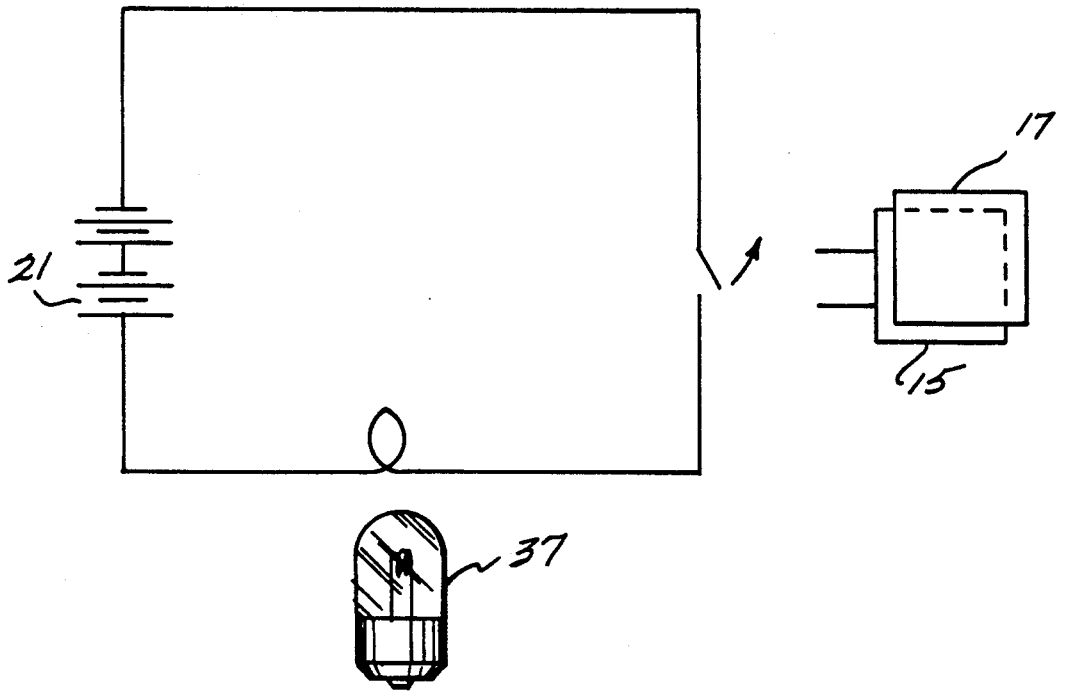
FIG. 5 is a schematic of the electrical circuitry of the display platform illustrated in FIG. 1.

Referring once again to FIG. 2 in conjunction with FIG. 5, emanating from the illuminating lamp receptacle 31 are electrical leads 33 and 35. One of the lamp receptacle electrical leads 35 is connected to one of the electrical leads 53 of the first membrane 15. The other lamp receptacle electrical lead 33 is connected to a terminal of one of the dry cell batteries 21. The dry cell batteries 21 are connected in parallel and the other polarity terminal of the other battery is connected to the other electrical lead 51 of the first membrane 15.

As noted above, the switch membranes 15 and 17 are disposed above and rest atop the housing 13 on surface 20 and shoulder 22, respectively. The shoulder 22 supports the membrane 17 spaced above membrane 15 such that if no object is placed on the top surface of the housing 13, the membranes will not contact one another. As better described below, when in this state, the pressure sensitive switch formed by the membranes is open. As illustrated best in FIGS. 3A and 3B, and described below, the membranes are comprised of thin, resilient layers of electrically non-conductive materials, such as plastic sheets, having electrical conductors etched on one surface. Preferably, the periphery of the membranes 15 and 17 are joined to the housing recess 14 in a waterproof manner.

Figure 3B:
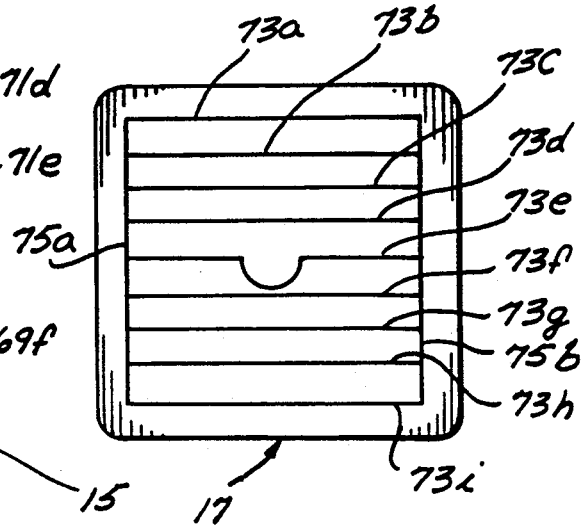
FIG. 3B is a plan view of a second flexible membrane with an electrically conductive etching pattern.

Referring now to FIGS. 3A and 3B, both the first and second membranes 15 and 17 have electrically conductive etchings on their facing surfaces. The first membrane 15 has two electrically disconnected patterns 61 and 63 connected to electrically conductive leads, 51 and 53, respectively. As shown in FIG. 3A, both electrically conductive leads 51 and 53 are located at the center of one side of the first membrane 15. Each of the electrically disconnected patterns 61 and 63 is generally comb-shaped, i.e., it includes a back 65 and 67 and a plurality of tines 69*a, b, c, d, e, f* and 71*a, b, c, d, e*. The end tines 69*a* and 69*f* and 71*a* and 71*e* are shorter than the other tines. The electrically disconnected patterns 61 and 63 are sized and oriented such that the long tines are interleaved and the short tines face one another. At no point do the backs 65 and 67 or the tines 69*a–f* and 71*a–e* contact one another.

The second membrane 17 contains a series of parallel, electrically conductive etchings 73*a–i*, joined together by a pair of orthogonal, longitudinal electrically conductive etchings 75*a* and 75*b* located at the ends of the series of conductive etchings. The etchings cover a large surface of the membrane. The membranes are joined such that the etchings 73*a–i* lie orthogonal to the direction of the tines 69*a–f* and 71*a–e* of the first membrane 15.

It is to be recognized that the specific etching patterns on the membranes 15 and 17 are not crucial, only that the first membrane contains two electrically disconnected patterns, one from each electrically conductive lead 51 and 53, and that the pattern on the second membrane 17 be of sufficient density to be able to "short" the etchings of the first membrane 15 when in contact therewith.

It is to be understood that rather than utilizing etching patterns 73*a–i*, one or more strips of metallic tape may be adhered to the underside of the membrane 17 in the direction orthogonal to the direction of tines 69*a–f* and 71*a–e*.

To illustrate the operation of the display platform, assume that an object 19 is placed on the top surface of the display platform 11. The weight of the object will deflect the center region of the second membrane 15 downward and close the spacing between the first and second membranes 15 and 17. As a result, the etchings or metallic tape of the second membrane 17 will contact the etchings of the first membrane 15, and thereby close the pressure sensitive switch 16 causing current to flow through the lamp 37. More specifically, referring to FIG. 5, which is a schematic diagram of the display platform's electrical circuitry (shown both electrically and mechanically), the completed circuit consists of the dry cell batteries 21, the illuminating lamp 37, and the pressure sensitive switch membranes 15 and 17. When the pressure sensitive switch is closed, the dry cell batteries 21 powers the illuminating lamp 37, resulting in light being focused by reflector 39 through the center apertures towards the object 19 to be displayed. The position of the filter disk 41 is manually controlled by rotating the filter disk 41 using the disc section 42 that protrudes from the side wall aperture 12 of the display platform. When the object 19 is removed, the second membrane 17 contracts, and returns to its normal state, thereby opening a space between the membranes 15 and 17 and turning off the illuminating lamp 37.

When a preferred embodiment of the invention has been illustrated and described, it will be appreciated that various changes may be made therein without departing from the spirit and scope of the invention. For example, the pressure sensitive switch mechanism may be of many types, such as a spring-loaded button switch. Consequently, it is to be understood, within the scope of the appended claims, the invention can be practiced otherwise than as specifically described herein.

The embodiments of the invention in which an exclusive property or privilege is claimed are defined as follows:

1. A display platform for illuminating and supporting an object, comprised of:

(a) a housing having a light passing panel for supporting an object;

(b) illuminating means located in said housing beneath said light passing panel for illuminating an object supported by said light passing panel;

(c) an electrical power supply located in said housing;

(d) pressure sensitive switch means connected in circuit with said illuminating means and said electrical power supply for activating said illuminating means when an object of sufficient weight is placed on said light passing panel;

(e) filter assembly disposed between said illuminating means and said light passing panel, said filter assembly having a plurality of individual filters; and, (f) means for manually moving the filter assembly, including when the object is disposed on the light passing panel, to selectively align the filters of the filter assembly with the illuminating means for filtering the light from the illuminating means to illuminate the object supported by the light passing panel.

2. A display platform as claimed in claim 1, wherein said filter assembly includes a shaft and a plate having a plurality of filter panels arranged in a circular array on the plate, said plate mounted on said shaft, said shaft positioned so as to allow said filter panels to be selectively positioned between said illuminating means and said light passing panel.

3. A display platform as claimed in claim 1, wherein said electrical power supply includes a battery.

4. A display platform as claimed in claim 1, wherein said illuminating means includes a lamp.

5. A display platform as claimed in claim 1, wherein said pressure sensitive switch means comprises:

(a) a first membrane disposed on said light transmitting panel and containing two electrically disconnected conductive patterns on the surface remote from said light transmitting panel;

(b) a second membrane containing an electrically connected conductive pattern on one surface positioned so as to face the two electrically disconnected conductive patterns contained on one surface of said first membrane and spaced from said first membrane such that said two electrically disconnected conductive patterns and said electrically connected conductive pattern are not in electrically conductive contact until an object of sufficient weight is placed on the other surface of said second membrane.

6. A display platform as claimed in claim 5, wherein the display platform includes a first surface for supporting the first membrane and supporting means for supporting the second membrane nominally spaced above the first membrane.

7. A display platform as claimed in claim 6, further comprising means for providing a moisture tight seal between the housing and the perimeter of the second membrane.

8. A display platform as claimed in claim 6, wherein the support means includes a shoulder surrounding the first surface.

9. A display platform as claimed in claim 5, wherein at least one of the first and second membranes is resiliently deformable under the weight of the object to place the two membranes into electrically contacting relationship when the object is placed on the membranes.

10. A display platform for supporting an object and illuminating the object being supported, comprising:

(a) a portable housing;

(b) illumination means located within the housing for illuminating an object supported by the display;

(c) an electrical power supply located within the housing; and, (d) pressure sensitive switch means connected in circuit with the illuminating means and the electrical power supply for activating the illuminating means when an object is placed on the display platform, said pressure sensitive switch means comprising:

(i) upper and lower membranes spaced above the illuminating means for receiving and supporting the object thereon, said upper and lower membranes:

having light transmitting portions to permit the light from the illuminating means to reach the object being supported; and, disposed in face to face nominally spaced apart relationship to each other;

(ii) electrical conductive elements disposed on the surfaces of the upper and lower membranes facing each other; and, (iii) wherein the upper membrane on which the object rests is resiliently flexible to flex downwardly upon the weight of the object to place the electrical elements of the upper and membranes into electrically conductive relationship thereby to activate the illuminating means.

11. A display platform according to claim 10, wherein the electrical element of one of the upper and lower membranes includes two electrically disconnective conductive patterns on the surface of the membrane facing the other membrane, and the other of the upper and lower membranes contains an electrically connected conductive pattern on the surface of the membrane facing the opposite membrane, whereupon when an object of sufficient weight is placed on the membranes, the electrically disconnective conductive pattern and the electrically connected conductive pattern are placed into electrically conductive contact with each other whereby to activate the illuminating means.

12. A display platform according to claim 10, further comprising filter means disposed between the lower membrane and the illuminating means for filtering the light from the illuminating means which illuminates the object being supported by the display platform, the filtering means including a plurality of individual filters and means for manually registrating the individual filters with the illuminating means to place a desired individual filter in registration with the illuminating means when the object is being supported on the display platform.

* * * * *